United States Patent [19]

Liska

[11] 4,046,644

[45] Sept. 6, 1977

[54] PROCESS FOR FORMING A GOLD-CHROMIUM ALLOY FROM AN ELECTRODEPOSITED GOLD-CHROMIUM SURFACE

[75] Inventor: John Joseph Liska, Fords, N.J.

[73] Assignee: American Standard Inc., New York, N.Y.

[21] Appl. No.: 689,433

[22] Filed: May 24, 1976

[51] Int. Cl.[2] ..... C25D 5/10; C25D 5/24; C25D 5/50

[52] U.S. Cl. ..... 204/37 R; 204/41; 204/46 G; 428/672

[58] Field of Search ..... 204/37 R, 41, 46 G; 148/13; 29/199

[56] References Cited

U.S. PATENT DOCUMENTS

| | | | |
|---|---|---|---|
| 2,039,328 | 5/1936 | Lukens | 204/46 G X |
| 2,133,995 | 10/1938 | Lukens | 204/46 G X |
| 2,978,390 | 4/1961 | Atwater et al. | 204/46 G |
| 3,502,548 | 3/1970 | Lyons | 204/41 X |
| 3,551,302 | 12/1970 | Woods et al. | 204/32 |
| 3,598,706 | 8/1971 | Freedman et al. | 204/46 G |

FOREIGN PATENT DOCUMENTS

| | | | |
|---|---|---|---|
| 917,739 | 2/1963 | United Kingdom | 204/37 R |

*Primary Examiner*—G. L. Kaplan
*Attorney, Agent, or Firm*—James J. Salerno, Jr.; Robert G. Crooks

[57] ABSTRACT

The invention relates to a process for heat diffusion of an electrodeposited gold layer on a chromium surface by simultaneously depassivating and cathodically gold plating a chromium surface by immersion and electroplating into an acid gold bath solution and diffusing the gold-chromium coating by heat to form a gold-chromium alloy which is abrasion resistant and which has a hardness substantially greater than that of a gold plated coating on a chromium surface which has not been heat diffused.

13 Claims, No Drawings

PROCESS FOR FORMING A GOLD-CHROMIUM ALLOY FROM AN ELECTRODEPOSITED GOLD-CHROMIUM SURFACE

BACKGROUND OF THE INVENTION

The present invention is directed to a process for producing gold-chromium alloy from an electrodeposited gold on a chromium surface by heat diffusion.

The prior art methods heretofore utilized for gold plating a chromium surface require depassivating or acid treating the chromium surface so that the chromium surface is properly activated to subsequently accept a gold plate by electrodepositing gold over the activated chromium surface. Such a process is described in a recent U.S. Pat. No. 3,551,302 where good adhesion of a gold coating on chromium can be obtained by first cathodically treating the chromium with an activating solution, water rinsing, immersing in a mild acid and then gold plating. As indicated above, after the chromium surface is cathodically treated, it is dipped into an acid solution having a concentration of about 10% and is water rinsed prior to gold plating. Thereafter it is heat treated at temperatures between 200° F and 900° F. to obtain a wear resistant finish.

In British Pat. No. 1,082,695 a process is described for the electrodeposition of gold onto a freshly depassivated chromium surface. However the patentee first points out that the chromium surface should be depassivated cathodically in a mild acid and then gold plated in a bath having a pH of between 2.5 and 4.5.

SUMMARY OF THE INVENTION

It is an object of the invention to provide a gold-chromium alloy which has an increased hardness and which has more abrasion resistance than a similar gold coating would have over a chromium surface which has not been heat diffused.

Another object of the invention is to provide a gold-chromium alloy on articles of manufacture such as plumbing fittings, costume jewelry, safe doors, safe deposit boxes and the like.

Another object of the invention is to provide a novel process for cathodically plating gold on a chromium surface which does not require a prior depassivating and acid wash step prior to gold plating the chromium surface.

Another object of the invention is to provide a process for the production of a gold-chromium alloy which is economical and in which the resulting color of the gold-chromium alloy can be varied in accordance with the atmosphere utilized during the heat diffusion step.

The invention generally contemplates a process for the heat diffusion of an electrodeposited gold layer on a chromium surface to form a gold-chromium alloy. The process comprises the steps of simultaneously depassivating and cathodically gold plating the chromium surface by immersing in an acid gold plating solution or bath having a pH of less than 2. The chromium surface is immersed in the plating solution for a period of time of up to 5 minutes at a current density of up to about 200 amperes per square foot with the bath temperature being maintained up to about 120° F. Thereafter the gold-chromium plated surface is heat diffused at a temperature of between 650° F to about 900° F for a period of time up to about 6 hours. The atmosphere during the heat diffusion treatment may be inert, reducing or oxidizing depending upon the resulting color to be achieved.

It has been found that an acid gold plating solution having a gold concentration of up to about 2 tr. oz. per gal., a pH of less than 2 will simultaneously depassivate a chromium surface and provide an adherent and uniform electro-deposited gold coating on the chromium surface without the necessity of first cathodically treating chromium in an activating solution, immersing in an acid solution and then water rinsing prior to gold plating. Acid gold solutions of less than 0.2 tr. ozs. per gal. are not suited because of the time required to deposit a sufficient gold coating over the chromium surface to give the article a brilliant gold color. It has also been found that more than 2 tr. ozs. of gold per gal. in an acid gold solution is not required since the gold coating can be produced within a reasonable period of time at lower gold concentration having sufficient thickness to achieve the desired brilliant gold color. It is preferred to employ an acid gold plating solution having a gold concentration of between 0.5 and about 1.5 tr. oz. per gal. and preferably 0.5 tr. oz. per gal.

The pH of the acid gold solution should be less than 2 and preferably less than 1 with best results being achieved at about a pH of 0.2.

The rate of heat diffusion of the gold-chromium plated surface to form a gold-chromium alloy varies inversely with time, that is, as the temperature increases, the time required to form the gold-chromium alloy decreases. The temperature for carrying out the heat diffusion should be above 650° F. and preferably below 900° F. It has been found that the formation of the gold-chromium alloy does not form at a sufficient rate at temperatures below 650° F. or in some cases where the temperature is not maintained for a sufficient period of time, substantially no conversion of the gold-chromium plated surface is achieved. It is preferred that the heat diffusion treatment be carried out at about 750° F. and below 900° F. The time required to effect sufficient conversion of the gold-chromium plated surface may vary between 5 minutes and 6 hours and is preferably carried out in one and one-half hours at 750° F. The formed gold-chromium alloy surface will have the improved physical characteristics of hardness and wear resistance which are greater than the same gold coating which has not been heat diffused.

The industry defines wear resistance of gold as a tendency to resist abrading. I have found that wear resistance can be correlated by X-ray diffraction studies which show a reduction of the metal crystal lattice spacing in the thermal diffusion process. In the case of a gold-chromium couple, the formation of a solution is indicated. An increase in the atomic percent of chromium in gold corresponds to an increase in wear resistance.

The physical characteristics of hardness and abrasion resistance of a gold-chromium alloy generally is not affected by use of particular atmosphere during the heat diffusion step. However, the color of the gold-chromium alloy finish can be controlled by employing a particular type of atmosphere during heat diffusion. The color obtained when a reducing atmosphere such as hydrogen or mixtures of hydrogen and carbon dioxide is employed will give a light gold color if the temperature is in excess of 650° F. If an inert atmosphere of nitrogen, neon, argon or the like is employed, a golden color or a golden color with a green cast is formed. If an oxidizing atmosphere of air or oxygen is employed a bronze-like color is formed.

The process may also incorporate a second gold plating or gold strike step. The second gold plating step need not be carried out in an acid gold solution of the type heretofore described. The gold bath may have a pH greater than 2 and may range from 3.3 to 4.0. The metallic gold content may range from 0.15 to 0.5 tr. oz. per gal. and temperature range may be maintained between room temperature and 140° F., the plating time may range from 1 min. up to 20 mins. at a current density of 10 amperes per square foot to 30 amperes per square foot. Thus multiple layers of gold may be plated onto the gold-chromium plated part and thereafter heat diffused and described above to form a gold-chromium alloy surface.

The following examples are set forth by way of illustration for a better understanding of the process as described herein. It should be understood that where the 3 inch by 4 inch panel part which is gold plated over a chromium surface is described in the Examples, the panel can be substituted for a particular part to be gold plated in accordance with the present invention. For example, the part to be plated may be a plumbing fitting, a safe door, safety deposit boxes or the like, costume jewelry or any other part which requires a metallic finish which is hard, relatively abrasion resistant and where gold is the surface of choice.

By the term, adherent gold deposit, as used herein and in conformance with the industry definition is meant that the gold coating cannot be rubbed off the chromium surface with a soft cloth except by wearing away the gold. Thus, the present Examples illustrate that a gold plate may be cathodically deposited over a chromium plated surface without first depassivating the chromium surface and thereafter heat diffused to form a gold-chromium alloy surface which has a hardness and is more abrasion resistant than the same gold coating which has not been heat diffused. The term plating as used in the following illustrative examples and elsewhere refers to cathodic electrodeposition.

EXAMPLE 1

A brass-coated panel, three inches by four inches, was plated in a standard bright nickel-plating solution for nine minutes at 35 amperes per square foot. The nickel-plated panel was then plated in a standard chromium-plating solution consisting of 24.7 gm/1 chromic acid and 2.5 gm/1 sulfuric acid for two minutes at 70 amperes per square foot and maintained at a temperature of 120° F. The panel was rinsed with water and placed in an acid gold bath consisting of 0.5 tr. oz./gal. of gold as a gold salt, an alloying element, cobalt, and sufficient hydrochloric acid to bring the pH to 0.2. The gold bath employed is a proprietary solution of the Sel Rex Company and is sold under the trade name AUROBOND TCL. A Hull cell was employed as a bath container in order to determine the acceptable plating range. The gold plating was carried out over a current density range of below 0.5 amperes per square foot to over 100 l amperes per square foot. A bright, uniform, adherent deposit of gold was obtained.

EXAMPLE 2

A brass-coated panel, three inches by four inches, was plated successively with bright nickel and chromium, as described in Example 1. The chromium-plated panel was plated in the acid gold bath of Example 1 in the Hull cell, except that only the pH of the solution was adjusted from 0.2 to 0.75 electrometric. A bright, uniform, adherent gold layer on the chromium surface was obtained employing the same current density, as in Example 1. No intermediate treatment for depassivating the chromium surface cathodically or in a separate acid bath before electroplating the gold was required.

EXAMPLE 3

A brass-coated panel was plated with bright nickel, as described in Example 1; however, a different proprietary chromium-plated was substituted. The chromium-plating solution is sold under the trade name REGULAR ECONOCHROME, and comprises a chromic-acid solution mixed with fluoride-sulfate catalyst. The chromic-acid concentration was maintained at 225 gm/1 and the sulfate maintained at 1.12 gm/1. The immersed nickel-coated panel was plated for 90 seconds in the chromium-plating solution at a current density of 120 amperes per square foot, the bath temperature being maintained at 112°-114° F. Thereafter, the panel was rinsed with water and gold plated according to conditions of Example 1. A bright, adherent, uniform coating of gold was obtained over the chromium surface using the same current density, as in Example 1. A gold coating was obtained without the necessity of depassivating or acid treating the chromium surface even where a different chromium-plating solution was employed.

EXAMPLE 4

A brass-coated panel was plated with bright nickel, as described in Example 1, and chromium-plated in a different proprietary chromium-plating bath for four minutes at a current density of about 120 amperes per square foot at a bath temperature of about 120° F. The chromium bath employed is sold under the trade name LUMA CHROME MC. This particular chromium-plating solution provides a discontinuous surface with a multitude of fine cracks. After the panel was chromium-plated, it was water-rinsed and gold-plated, as in Example 1. A bright, uniform, adherent gold coating was obtained over the same current density range, as described in Example 1. This example illustrates that no intermediate treatment of depassivation or acid treatment is required between the chromium-plating step and the gold-plating step, even where the chromium-plated surface has a multitude of fine cracks.

The following example illustrates that the acid gold solution of Example 1 does not substantially affect the chromium surface prior to the gold plating.

EXAMPLE 5

Chromium-plated parts, panels were weighed and placed in an acid gold-plating solution of Example 1 without any electrical connection for a period of ten minutes. The chromium-plated parts were removed, dried and reweighed. The weight losses were found to be less than 0.01 mg per square inch per minute, which is within the limits of experimental error. In addition, no immersion deposit of gold was observed on the chromium surface, neither was there any loss of brightness of the chromium surface which would indicate an attack on the chromium surface by the acid in the gold solution.

The following examples show that the abrasion resistance of a gold-plated chromium surface, as made in Example 1, does not increase in abrasion resistance although heated to a temperature of 650° F. However, as the temperature is increased, the abrasion resistance increases, indicating a diffusion of chromium in gold.

EXAMPLE 6

A chromium-plated panel, prepared as in Example 1, was rinsed with water and gold-plated in the acid gold solution of Example 1 for 2 minutes at a current density of 35 amperes per square foot. The gold-plated panel was placed in X-ray diffraction apparatus and the diffraction profile determined for the 420 line, 2 Sigma. The angle of the particular line was 116.2°. The gold-plated panel was heated at 250° F. for one-half hour, the X-ray diffraction profile for this line was again determined and found to be 116.2° indicating no gold diffusion into the chromium layer.

EXAMPLE 7

The panel from Example 6 was again heated to 550° F. for a period of 1 and ½ hours. The X-ray diffraction angle was found to be 116.6°. Utilizing the table from Pearson, *Handbook and Lattice Spacing and Structure,* Vol. 2, 1967, from the change of the angle the percentage of chromium in gold for this line calculated to be 1 atomic percent.

EXAMPLE 8

The panel from Example 7 was again heated to 650° F., an increase of 100° for a period of 1 hour. The X-ray diffraction angle for this line was found to be 116.95°. From the tables indicated above, the percentage of chromium in gold was calculated to be 2 atomic percent.

EXAMPLE 9

The panel of Example 8 was again heated to 650° F for a period of 5 hours or a total of 6 hours at 650° F. The diffraction angle for this line was found to be 117.6° and the percentage of chromium in gold was calculated to be 10 atomic percent.

EXAMPLE 10

The panel from Example 9 was again heated this time at 750° F., an increase of 100° F, again for a period of 1 ½ hours. The diffraction angle was found to be 118.2° and the percentage of chromium in gold was calculated to be 19 atomic percent.

The following examples illustrate the effect of different atmosphere conditions on the finish of the heat-diffused surface.

EXAMPLE 11

A gold-plated panel, made in accordance with Example 1, was heated in an oven at 650° F. for a period of 45 minutes in a nitrogen atmosphere. Upon cooling, no change in abrasion resistance was observed when compared to an unheated gold-plated panel made in accordance with Example 1 when both were rubbed with a pencil eraser.

EXAMPLE 12

A gold-plated panel, made in accordance with Example 1, was heated in an oven at 650° for 2 hours in a nitrogen atmosphere. Employing the same test as in Example 11, no change in abrasion resistance was observed in the heated panel over the unheated panel.

EXAMPLE 13

A gold-plated panel, made in accordance with Example 1, was heated at 650° F. for a period of 3 hours in a nitrogen atmosphere. Employing the same test as in Example 11, only a small increase in abrasion resistance was discernible in the heated panel over the unheated panel.

EXAMPLE 14

A gold-plated panel, made in accordance with Example 1, was heated at 710° F. for 2 and ½ hours in a nitrogen atmosphere. Employing the same test as in Example 11, a large increase in abrasion resistance in the heat-treated panel was observed when compared to the unheated panel.

EXAMPLE 15

A gold-plated panel, made in accordance with Example 1 was heated at 750° F. for 15 minutes in a nitrogen atmosphere. Employing the same test as in Example 11, a large and significant increase in abrasion resistance in the heat-treated panel was observed when compared to the unheated panel.

The following examples show the effect of oven atmosphere on the color of the finished heat-diffused surface.

EXAMPLE 16

A gold-plated panel, made in accordance with Example 1, was heated at 750° F. for one hour in an air atmosphere. The resulting color of the heated panel was bronzelike and uniform over its entire surface. When employing the same test as in Example 11, the abrasion resistance was greatly increased when compared to the unheated panel.

EXAMPLE 17

A gold-plated panel, made in accordance with Example 1, was heated at 750° F. for one hour in a nitrogen atmosphere. The color of the surface resembled that of a 24-karat gold with a slight greenish cast and was uniform. Employing the same test as in Example 11, the abrasion resistance was greatly increased when compared to the unheat panel.

EXAMPLE 18

A gold-plated panel, made in accordance with Example 1, was heated at 750° F. for one hour in an atmosphere of 98 percent carbon dioxide and 2 percent hydrogen. The color of the gold resembled that of 24-karat gold and was uniform. Employing the same test as in Example 11, good abrasion resistance was obtained when compared to the unheated panel.

EXAMPLE 19

A gold-plated panel, made in accordance with Example 1, was heated at 750° F. for 1 and ½ hours in a hydrogen atmosphere. The color of the gold was light yellow. Employing the same test as in Example 1, a small increase in the abrasion resistance was observed.

EXAMPLE 20

This example illustrates that multiple layers of gold coating employing different gold-plating solutions can be plated over a chromium-plated part and thereafter heat-diffused to form a gold-chromium alloy finish.

A section of a bathroom plumbing fitting was chromium-plated as in Example 1. The part was rinsed in water, placed in the acid gold bath of Example 1 to a thickness of 6.6 millionths of an inch, as determined by weight gain. The gold-plated part was water-rinsed and placed in a different gold-plating solution, which is designed to electrodeposit a 24-karat coating and plated to an additional thickness of 5.8 millionths of an inch, as determined by weight gain. The gold-plating solution employed is sold under the trade name AUROBOND TN by The Sel-Rex Company. After water-rinsing and drying, the part was heat-diffused in an oven having a nitrogen atmosphere for 70 minutes while the temperature was maintained at 790° F. Upon removal, the part was found to have increased abrasion resistance when compared to a similar gold-plated part that had not been subjected to the heat-diffusion step.

What is claimed is:

1. A process for the heat diffusion of an electro-deposited gold layer on a chromium surface to form abrasion resistance gold-chromium alloy consisting essentially of simultaneously depassivating and cathodically gold plating the chromium surface in an aqueous acid gold plating solution having a gold content of about 0.2 to 2 tr. ozs. per gal, a pH of less than 2 and maintaining said gold solution at about room temperature to about 120° F. whereby the weight loss of said chromium surface is less than 0.01 mg/in²/-min;

said surface being plated in said plating solution for a period of time of from about 5 secs. to about 5 mins. at a current density of from about 1 ampere per square foot to about 200 amperes per square foot whereby the amount of gold deposited over said depassivated chromium surface is sufficient to form an alloy with said chromium layer while maintaining a gold color;

removing the gold-chromium plated surface from said plating solution, water rinsing; and thereafter heat diffusing the gold plated chromium surface to form a gold-chromium alloy by subjecting said gold-chromium surface to elevated temperatures of from about 650° F to about 900° F. for a period of time of from about 2 minutes to about 6 hours whereby a gold-chromium alloy surface is produced which has a hardness and is more abrasion resistant than the same gold coating which has not been heat diffused.

2. A process for the heat diffusion of an electro-deposited gold layer on a chromium plated plumbing fitting to form an abrasion resistant gold-chromium alloy finish consisting essentially of:

simultaneously depassivating and cathodically gold plating the chromium plated plumbing fitting in an aqueous acid gold plating solution having a gold content of about 0.2 to 2 tr. ozs. per gal., pH of less than 2 and maintaining said gold plating solution at about room temperature to about 120° F. whereby the weight loss of said chromium plated fitting is less than 0.01 mg/in²/min;

said surface being plated in said plating solution for a period of time of from about 5 secs. to about 5 mins. at a current density of from about 1 ampere per square foot to about 200 amperes per square foot whereby the amount of gold deposited over said depassivated chromium plated fitting is sufficient to form an alloy with said chromium plated fitting while maintaining a gold color;

removing the gold-chromium plated surface from said plating solution, water rinsing; and thereafter heat diffusing the gold plated chromium surface to form a gold-chromium alloy by subjecting said gold-chromium surface to elevated temperatures of from about 650° F. to about 900° F. for a period of time of from about 2 minutes to about 60hours whereby a gold-chromium alloy surface is produced which has a hardness and is more abrasion resistant than the same gold coating which has not been heat diffused.

3. The process of claim 2 wherein the heat diffusion of the gold plated layer and chromium plated layer is carried out in an oxidizing atmosphere.

4. The process of claim 2 wherein the heat diffusion of the gold layer and chromium plated layer is carried out in a reducing atmosphere.

5. The process of claim 2 wherein the heat diffusion of the gold plated layer and chromium plated layer is carried out in an inert atmosphere.

6. The process of claim 2 wherein the pH of the acid gold plating solution is between 0.2 and 1.

7. The process of claim 2 wherein the pH of the acid gold plating solution is 1.

8. The process of claim 2 wherein the pH of the acid gold plating solution is 0.2.

9. The process of claim 2 wherein the gold content of the acid plating solution is between 0.5 and 1.5 tr. oz. per gal.

10. The process of claim 2 wherein the gold content of the acid gold plating solution is 0.5 tr. oz. per gal.

11. The process of claim 2 wherein the heat diffusion step is carried out at a temperature of about 750° F. to about 900° F.

12. The process of claim 2 wherein the heat diffusion step is carried out at a temperature of 750° F.

13. A process for the heat diffusion of an electro-deposited gold layer on a chromium plated plumbing fitting to form an abrasion resistant gold-chromium alloy finish comprising:

simultaneously depassivating and cathodically gold plating a chromium plated plumbing fitting in an aqueous acid gold plating solution having a gold content of about 0.2 to 2 tr. ozs. per gal, a pH of less than 2 and maintaining said gold solution at about room temperature to about 120° F.;

said chromium plated fitting being placed in said plating solution for a period of time of from 5 secs. to about 5 mins. at a current density of from about 1 ampere per square foot to about 200 amperes per square foot;

removing the gold-chromium plated fitting from said plating solution, water rinsing;

immersing said aqueous gold plated fitting in a second aqueous gold plating solution having a pH of from 3.3. to 4.0; a gold content of from 0.15 to 0.5 tr. oz. per gal.; at a current density of from 10 amperes per square foot to about 30 amperes per square foot; for a period of time of from 1 min. to about 2 mins. to provide a 24 Karat gold finish; and thereafter diffusing the gold plated chromium surface on said fitting to form a gold-chromium alloy by subjecting said gold-chromium fitting to elevated temperatures of from about 650° to about 900° F. for a period of time of from about 5 mins. to about 6 hrs. whereby a gold-chromium alloy surface on said plumbing fitting is produced which has a hardness and is more abrasion resistant than the same gold coating which has not been heat diffused.

* * * * *